US009800973B1

(12) United States Patent
Chatot et al.

(10) Patent No.: US 9,800,973 B1
(45) Date of Patent: Oct. 24, 2017

(54) SOUND SOURCE ESTIMATION BASED ON SIMULATED SOUND SENSOR ARRAY RESPONSES

(71) Applicant: X Development LLC, Mountain View, CA (US)

(72) Inventors: Olivier Chatot, Tokyo (JP); Satoshi Kagami, Tokyo (JP); Anja Austermann, Tokyo (JP)

(73) Assignee: X Development LLC, Mountain View, CA (US)

( * ) Notice: Subject to any disclaimer, the term of this patent is extended or adjusted under 35 U.S.C. 154(b) by 0 days.

(21) Appl. No.: 15/271,916

(22) Filed: Sep. 21, 2016

Related U.S. Application Data

(60) Provisional application No. 62/334,300, filed on May 10, 2016.

(51) Int. Cl.
*H04R 3/00* (2006.01)

(52) U.S. Cl.
CPC ..... *H04R 3/005* (2013.01); *H04R 2430/03* (2013.01); *H04R 2430/21* (2013.01)

(58) Field of Classification Search
CPC . H04R 3/005; H04R 1/08; H04R 1/32; H04R 2410/01; H04R 3/00; H04R 2430/23; G10L 2021/02166; G10L 21/0216; G10L 21/0264; G06K 7/10712; G06K 7/10792
USPC ..... 381/92, 56–58, 94.1–94.4; 700/94
See application file for complete search history.

(56) References Cited

U.S. PATENT DOCUMENTS 7,162,043 B2 * 1/2007 Sugiyama ..... G01H 3/00 367/125
7,783,054 B2 * 8/2010 Ringlstetter ..... H04R 29/003 381/59
8,155,346 B2 * 4/2012 Yoshizawa ..... G01S 3/8083 381/92
8,218,786 B2 * 7/2012 Koga ..... H04R 3/005 381/122
8,773,952 B2 * 7/2014 Shin ..... G01S 3/8006 367/125
9,357,293 B2 * 5/2016 Claussen ..... H04R 3/00
(Continued)

FOREIGN PATENT DOCUMENTS

JP 2007093251 A 4/2007

*Primary Examiner* — Lao Lun-See
(74) *Attorney, Agent, or Firm* — McDonnell Boehnen Hulbert & Berghoff LLP

(57) ABSTRACT

An implementation operable by a device coupled to a sound sensor array including a plurality of sound sensors in a particular arrangement is provided. The implementation involves obtaining a plurality of simulated responses mapping respective simulated physical arrangements of one or more simulated sound sources to respective expected outputs from the sound sensor array. The implementation also involves receiving a response based on output from the sound sensor array. The response may indicate detection of sounds from a plurality of sound sources in an environment of the sound sensor array. The implementation also involves comparing the received response with at least one of the plurality of simulated responses. The implementation also involves estimating locations of the plurality of sound sources relative to the sound sensor array based on the comparison. The implementation also involves operating the device based on the estimated locations of the plurality of sound sources.

20 Claims, 6 Drawing Sheets

(56) References Cited

U.S. PATENT DOCUMENTS

| | | | |
|---|---|---|---|
| 2013/0308790 | A1 | 11/2013 | Claussen |
| 2014/0198918 | A1 | 7/2014 | Li et al. |
| 2015/0242180 | A1 | 8/2015 | Boulanger-Lewandowski et al. |

* cited by examiner

SOUND SOURCE ESTIMATION BASED ON SIMULATED SOUND SENSOR ARRAY RESPONSES

CROSS-REFERENCE TO RELATED APPLICATION

This application claims priority to U.S. Provisional Patent Application Ser. No. 62/334,300, filed on May 10, 2016, the entirety of which is incorporated herein by reference.

BACKGROUND

As technology advances, various types of computer-operated systems, such as personal computers, hand-held devices, robotic devices, autonomous vehicles, etc., are being employed for performing a variety of functions. As computer-operated systems become increasingly prevalent in numerous aspects of modern life, it is desirable for computer-operated systems to be efficient. Therefore, a demand for efficient computer-based systems has helped open up a field of innovation in sensing techniques, as well as sensor design and assembly.

Sound sensors (e.g., infrasound sensors, microphones, ultrasound sensors, etc.) are sensors used to detect sounds. A sound sensor array is a device that includes multiple sound sensors arranged in predetermined positions relative to one another. A computing device can employ various signal processing techniques to deduce information pertaining to sounds detected by a sound sensor array.

Sound source direction estimation is an example signal processing technique for estimating the direction of a detected sound. In some implementations, this technique may involve using a mixer to sum the signals received from individual sound sensors in the array. Due to offset(s) between positions of the sound sensors in the array, a first sound sensor may detect a sound before a second sound sensor. By accounting for the delay between the two detections, a computing device employing this technique may process the combined signal from the mixer to determine an arrival angle (e.g., direction) of the detected sound.

Sound source localization is an example signal processing technique for estimating the location of a sound source emitting a detected sound. In some implementations, this technique may involve measuring (or estimating) the direction (or angle of arrival) of the detected sound at two (or more) predetermined locations on the array. By accounting for the arrival angles at the two locations, a computing device employing this technique may process outputs from the sound sensor array(s) to estimate (e.g., triangulate) the location of the sound source.

In scenarios where a sound sensor array detects a combination of sounds emitted by multiple sound sources, sound source separation is an example signal processing technique for separating (or recovering) a sound emitted by one of the multiple sound sources. In some implementations, this technique may involve applying one or more statistical algorithms, such as principal components analysis or independent components analysis, to output(s) from the sound sensor array. By applying the one or more statistical algorithms, a computing device employing this technique may identify spectral components of individual sounds in the detected combination of sounds. The computing device may then recover (or estimate) one sound in the detected combination of sounds by removing (e.g., via spectral subtraction, etc.) respective spectral components associated with other sounds in the detected combination of sounds.

SUMMARY

The present application discloses implementations that relate to sound source direction estimation, localization, and separation. In one example, the present application describes a method operable by a device coupled to a sound sensor array. The sound sensor array includes a plurality of sound sensors in a particular physical arrangement. The method involves obtaining a plurality of simulated responses mapping respective simulated physical arrangements of one or more simulated sound sources to respective expected outputs from the sound sensor array. The method also involves receiving, based on output from the sound sensor array, a response indicative of the sound sensor array detecting sounds from a plurality of sound sources in an environment of the sound sensor array. The method further involves comparing the received response with at least one of the plurality of simulated responses. Additionally, the method involves estimating locations of the plurality of sound sources relative to the sound sensor array based on the comparison. Further, the method involves operating the device based on the estimated locations of the plurality of sound sources relative to the sound sensor array.

In another example, the present application describes an article of manufacture. The article of manufacture includes a non-transitory computer-readable medium, having stored thereon program instructions that, upon execution by a computing device, cause the computing device to perform operations. The operations include obtaining, for a sound sensor array comprising a plurality of sound sensors in a particular physical arrangement, a plurality of simulated responses mapping respective simulated physical arrangements of one or more simulated sound sources to respective expected outputs from the sound sensor array. The operations also include determining, based on output from the sound sensor array, a response indicative of the sound sensor array detecting sounds from a plurality of sound sources in an environment of the sound sensor array. The operations further include comparing the determined response with at least one of the plurality of simulated responses. Additionally, the operations include estimating locations of the plurality of sound sources relative to the sound sensor array based on the comparison. Further, the operations include operating based on the estimated locations of the plurality of sound sources relative to the sound sensor array.

In yet another example, the present application describes a device comprising a communication interface, at least one processor, and data storage. The data storage storing program instructions that, when executed by the processor, cause the device to perform functions. The functions comprise obtaining, for a sound sensor array that includes a plurality of sound sensors in a particular physical arrangement, a plurality of simulated responses mapping respective simulated physical arrangements of one or more simulated sound sources to respective expected outputs from the sound sensor array. The functions also comprise receiving, from a remote device via the communication interface, a response based on output from the sensor array. The response is indicative of the sound sensor array detecting sounds from a plurality of sound sources in an environment of the sound sensor array. The sound sensor array is included in the remote device. The functions further comprise comparing the received response with at least one of the plurality of simulated responses. Additionally, the functions comprise estimating locations of the plurality of sound sources relative to the sound sensor array based on the comparison. Further, the functions comprise operating based on the estimated locations of the plurality of sound sources relative to the sound sensor array.

In still another example, the present application describes a system. The system includes a means for obtaining a plurality of simulated responses mapping respective simulated physical arrangements of one or more simulated sound sources to respective expected outputs from a sound sensor array. The sound sensor array includes a plurality of sound sensors arranged in a particular physical arrangement. The system also includes a means for receiving, based on output from the sound sensor array, a response indicative of the sound sensor array detecting sounds from a plurality of sound sources in an environment of the sound sensor array. The system further includes a means for comparing the received response with at least one of the plurality of simulated responses. Additionally, the system includes a means for estimating locations of the plurality of sound sources relative to the sound sensor array based on the comparison. Further, the system includes a means for operating the device based on the estimated locations of the plurality of sound sources relative to the sound sensor array.

The foregoing summary is illustrative only and is not intended to be in any way limiting. In addition to the illustrative aspects, embodiments, and features described above, further aspects, embodiments, and features will become apparent by reference to the figures and the following detailed description and the accompanying drawings.

DETAILED DESCRIPTION

Figure 1:
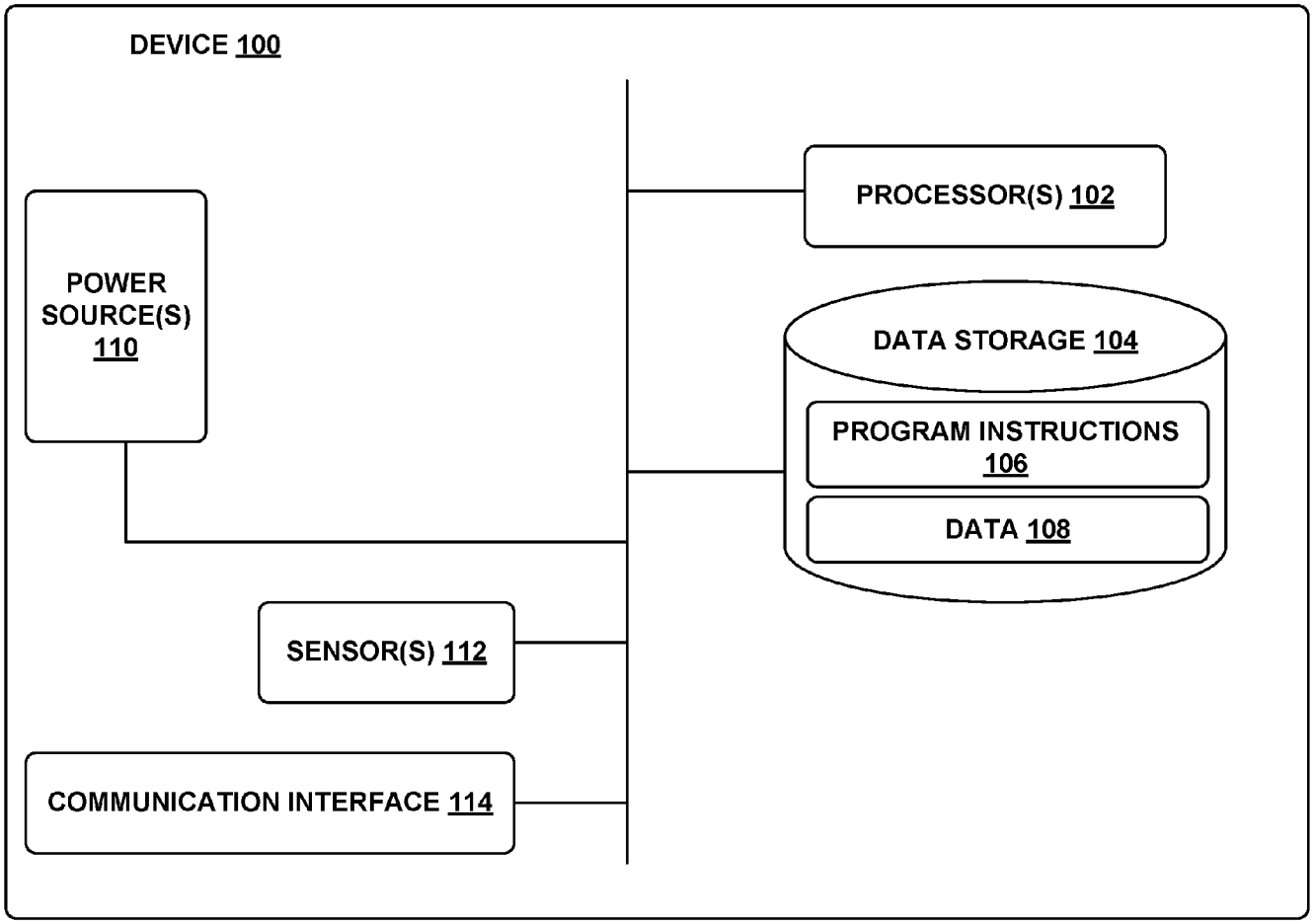
FIG. 1 illustrates a configuration of a robotic system, according to an example embodiment.

The following detailed description describes various features and functions of the disclosed implementations with reference to the accompanying figures. The illustrative implementations described herein are not meant to be limiting. It may be readily understood that certain aspects of the disclosed implementations can be arranged and combined in a wide variety of different configurations.

I. OVERVIEW

Sound sensor arrays can be employed by various computer-operated systems. In one example, an entertainment system can use a sound sensor array to estimate locations of users relative to the system. For instance, the system can adjust output or power consumption of a audio output device to efficiently and effectively provide sound content according to the estimated locations. In another example, a robotic device can use a sound sensor array to adjust its operation in response to a voice command from a user. For instance, where the voice command indicates a request for the robotic device to move toward the user, the robotic device can use the sound sensor array to estimate a direction from which the voice command was detected. In still another example, an automatic speech recognition system can use a sound sensor array to separate detected speech sounds from multiple speakers. Other examples are possible as well.

To perform these operations, a system may apply various signal processing techniques to outputs from a sound sensor array. Example techniques include sound source direction estimation, sound source localization, and/or sound source separation, among others.

However, in some scenarios, these techniques are computationally expensive or time consuming. Additionally, in scenarios where a sound sensor array detects a combination of sounds originating from multiple sound sources, interaction between the detected sounds can affect the reliability of these techniques.

By way of example, some techniques may involve spectral processing of the output from the sound sensor array. For instance, consider a scenario where the output from the array includes a conditioned signal that is based on a combination of signals from one or more individual sound sensors in the array. In this scenario, a computing device is configured to separate a particular sound from other sounds in a combination of detected sounds indicated by the conditioned signal (e.g., sound source separation). To do so, the computing device determines spectral components of the conditioned signal. The computing device then employs spectral subtraction to remove spectral components associated with the other sounds from the spectral components of the conditioned signal. The remaining spectral components in this scenario (i.e., components of the particular sound) are then processed to recover or estimate the particular sound. However, if the detected sounds in this scenario have overlapping spectral components (e.g., same frequency), then spectral subtraction would result in loss of information related to the particular sound. As a result, the estimated or recovered sound in this scenario may vary from the particular sound detected by the array. Other examples where interaction between sounds affects reliability of these techniques are possible as well.

Thus, it may be desirable to improve the efficiency and accuracy of signal processing techniques used with sound sensor array outputs.

An example implementation herein involves a computing device coupled to a sound sensor array, or in communication with another device that includes the sound sensor array. The sound sensor array includes a plurality of sound sensors in a particular physical arrangement. In this embodiment, the computing device is configured to obtain a plurality of simulated responses mapping respective simulated physical arrangements of one or more simulated sound sources to respective expected outputs from the sound sensor array. For example, a simulated response can be generated by simulating sound waves according to particular simulation parameters, and determining expected outputs from the array in response to detection of the simulated sound waves. A non-exhaustive list of example parameters includes: sound characteristics (e.g., amplitude, frequency, direction of propagation, etc.), number of sound sources, sound source positions, among others. Similarly, other simulated responses can be generated using different parameters.

In some examples, the plurality of simulated responses are precomputed or predetermined. The predetermined simulated responses are then stored in a dataset mapping the respective simulated responses to respective simulated physical arrangements of sound source(s) (and/or other simulation parameters). In these examples, the computing device is configured to obtain the simulated responses by accessing the dataset.

Further, in this implementation, the computing device is also configured to receive a response indicative of the sound sensor array detecting sounds from a plurality of sound sources in an environment of the sound sensor array. The output of the array depends on a predetermined hardware configuration thereof as well as characteristics of the detected sounds. For example, consider a scenario where the array includes three sensors linearly arranged with a separation of ten centimeters between adjacent sensors. In this scenario, sound waves propagating toward the array may be detected by a first sensor, a second sensor, and a third sensor in that order. The time between the detections in this scenario is based on the direction of the sound waves and the respective distances (e.g., ten centimeters) between the respective sensors. As a variation of this scenario, where the sound waves are propagating from an opposite direction, the sound waves may then be detected by the third sensor, then the second sensor, and then the first sensor. As yet another variation of this scenario, where the respective distances between the sensors are different from ten centimeters, the time between the detections would be different than the previous two scenarios. Other scenarios are possible as well. Thus, the computing device can process the output from the sensor array based on the predetermined hardware configuration to generate the received response.

Further, in this implementation, the computing device is configured to compare the received response with at least one of the obtained plurality of simulated responses, and estimate locations (or directions) of the plurality of sound sources relative to the sound sensor array accordingly. In some examples, the computing device identifies a simulated response having similar characteristics (e.g., local power level maxima, etc.) to corresponding characteristics of the received response. In one example, the computing device may then estimate the locations of the plurality of sound sources as simulated locations of simulated sound source(s) associated with the identified simulated response. In another example, the computing device can use the simulated locations as a basis for estimating the locations of the sound sources in the environment. For instance, the computing device may estimate the locations as midpoint locations between two simulated sound sources associated with two identified simulated responses. Other examples are possible as well.

II. EXAMPLE SYSTEMS AND DEVICES

Systems and devices involving example implementations will now be described in greater detail. In general, the embodiments disclosed herein can be used with any computing device configurable for processing data associated with a sound sensor array. In general, example implementations herein include computing devices equipped with a sound sensor array and/or computing devices in communication with a sound sensor array equipped device. An example system may be implemented in or take the form of any device, such as robotic devices, electromechanical systems, vehicles (cars, trains, aerial vehicles, etc.), industrial systems (e.g., assembly lines, etc.), medical devices (e.g., ultrasound devices, etc.), hand-held devices (e.g., cellular phones, personal digital assistants, etc.), personal computers, or mobile communication systems, among other possibilities.

FIG. 1 illustrates an example configuration of a device that may be used in connection with the implementations described herein. The device 100 may be configured to operate autonomously, semi-autonomously, and/or using directions provided by user(s). The device 100 may be implemented in various forms, such as a robot, server device, personal computer, or any other computing device.

As shown in FIG. 1, device 100 may include processor(s) 102 and data storage 104. Device 100 may also include, power source(s) 110, sensor(s) 112, and communication interface 114. Note that device 100 is shown for illustrative purposes, and may include more or fewer components. The various components of device 100 may be connected in any manner, including wired or wireless connections. Further, in some examples, components of device 100 may be distributed among multiple physical entities rather than a single physical entity. Other example illustrations of device 100 may exist as well. In one implementation, sensors 112 are alternatively included in a remote device (not shown) communicatively coupled to device 100 via communication interface 114.

Processor(s) 102 may operate as one or more general-purpose hardware processors or special purpose hardware processors (e.g., digital signal processors, application specific integrated circuits, etc.). The processor(s) 102 may be configured to execute computer-readable program instructions 106, and manipulate data 108, both of which are stored in the data storage 104. The processor(s) 102 may also directly or indirectly interact with other components of the robotic system 100, such as sensor(s) 112 and/r power source(s) 110.

The data storage 104 may be one or more types of hardware memory. For example, the data storage 104 may include or take the form of one or more computer-readable storage media that can be read or accessed by processor(s) 102. The one or more computer-readable storage media can include volatile and/or non-volatile storage components, such as optical, magnetic, organic, or another type of memory or storage, which can be integrated in whole or in part with processor(s) 102. In some implementations, data storage 104 can be a single physical device. In other implementations, data storage 104 can be implemented using two or more physical devices, which may communicate with one another via wired or wireless communication. As noted previously, data storage 104 may include the computer-readable program instructions 106 and the data 108. The data 108 may be any type of data, such as configuration data, sensor data, and/or diagnostic data, among other possibilities.

During operation, various components of device 100 may communicate with one another via wired or wireless connections (e.g., via communication interface 114), and may further be configured to communicate with one or more remote devices.

The device 100 may include one or more power source(s) 110 configured to supply power to various components of the device 100. Among other possible power systems, the device 100 may include a hydraulic system, electrical system, batteries, and/or other types of power systems. Any type of power source may be used to power the device 100, such as electrical power or a gasoline engine.

The device 100 may also include sensor(s) 112 arranged to sense aspects of the device 100 and/or an environment of the device 100. The sensor(s) 112 may include one or more force sensors, torque sensors, velocity sensors, acceleration sensors, position sensors, proximity sensors, motion sensors, location sensors, load sensors, temperature sensors, touch sensors, depth sensors, ultrasonic range sensors, infrared sensors, object sensors, sound sensors, and/or cameras, among other possibilities.

The sensor(s) 112 may provide sensor data to the processor(s) 102 (perhaps by way of data 108) to allow for interaction of the device 100 with its environment, as well as monitoring of the operation of the device 100. In an example configuration, sensor(s) 112 include sound sensors (e.g., microphones, infrasound sensors, ultrasound sensors, etc.), sound sensor arrays, and/or other sensors for capturing information of the environment in which device 100 is operating, or an environment in which a remote device (not shown) is operating. In some examples, the sensor(s) 112 may monitor the environment in real time, and detect obstacles, weather conditions, temperature, sounds, and/or other aspects of the environment. The device 100 may include other types of sensors as well. Additionally or alternatively, the system may use particular sensors for purposes not enumerated herein.

Communication interface 114 may include one or more wireless interfaces and/or wireline interfaces that are configurable to communicate with other computing devices. In some embodiments, device 100 is configured to communicate with one or more other computing devices directly (via communication interface 114). In other embodiments, device 100 is configured to communicate with one or more other computing devices through a network (e.g., Internet, local-area network, wide-area network, etc.). In these embodiments, communication interface 114 is configured to access such network. The wireless interfaces, if present, may include one or more wireless transceivers, such as a BLUETOOTH® transceiver, a Wifi transceiver perhaps operating in accordance with an IEEE 802.11 standard (e.g., 802.11b, 802.11g, 802.11n), a WiMAX transceiver perhaps operating in accordance with an IEEE 802.16 standard, a Long-Term Evolution (LTE) transceiver perhaps operating in accordance with a 3rd Generation Partnership Project (3GPP) standard, and/or other types of wireless transceivers configurable to communicate via local-area or wide-area wireless networks, or configurable to communicate with a wireless device. The wireline interfaces, if present, may include one or more wireline transceivers, such as an Ethernet transceiver, a Universal Serial Bus (USB) transceiver, or a similar transceiver configurable to communicate via a twisted pair wire, a coaxial cable, a fiber-optic link or other physical connection to a wireline device or network.

III. EXAMPLE SOUND SENSOR ARRAY CONFIGURATION

Figure 2:
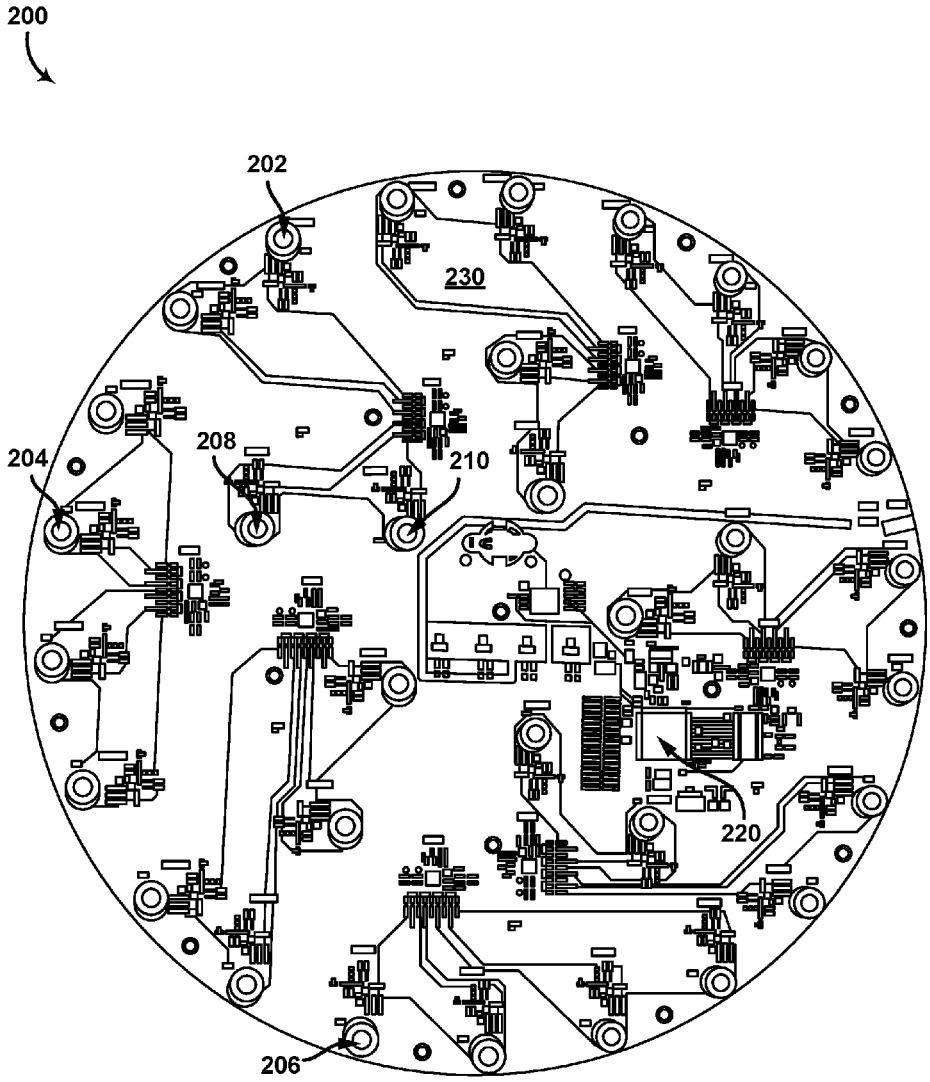
FIG. 2 illustrates a sound sensor array, according to an example embodiment.

FIG. 2 illustrates a sound sensor array device 200, according to an example embodiment. In some examples, device 200 is included in sensors 112 of the device 100. In other examples, device 200 is coupled to a remote processor-equipped device (e.g., via a communication interface, etc.), in communication with the device 100. Other examples are possible as well in line with the discussion above.

As shown, device 200 includes a plurality of sound sensors exemplified by sound sensors 202, 204, 206, 208, and 210, one or more signal conditioners exemplified by signal conditioner 220, and a platform 230. In one implementation, device 200 includes thirty two sound sensors (e.g., including sound sensors 202, 204, 206, 208, 210). In other implementations, device 200 includes fewer or more sound sensors.

Sound sensors 202, 204, 206, 208, 210 are configured to detect sound(s) and output signals indicative of the detected sound(s). In some implementations, sound sensors 202, 204, 206, 208, 210 include an acoustic-to-electric transducer that converts pressure variations (e.g., acoustic waves, etc.) in a propagation medium (e.g., air, water, etc.) of the sound to an electrical signal. Example sound sensors include microphones, dynamic microphones, condenser microphones, ribbon microphones, carbon microphones, fiber optic microphones, laser microphones, liquid microphones, micro-electrical-mechanical-system (MEMS) microphones, piezoelectric microphones, infrasound sensors, ultrasound sensors, and ultrasonic transducers, among others. In some examples, sound sensors 202, 204, 206, 208, 210 are configured to detect sounds within a particular frequency range. For instance, a particular sound sensor may be configured for detecting sounds within human-audible frequencies (e.g., 20 to 20,000 Hertz), or sounds within ultrasonic frequencies (e.g., greater than 18,000 Hertz). Other frequency ranges are possible as well. In other examples, sound sensors 202, 204, 206, 208, 210 are configured to detect sounds within any particular acoustic frequency range.

Signal conditioner 220 includes one or more electronic components configurable for manipulating electrical signals from one or more of the sound sensors (e.g., sensors 202, 204, 206, 208, 210, etc.) in the device 200. In some implementations, signal conditioner 220 includes analog and/or digital electronic components, such as any combination of mixers, amplifiers, buffers, delays, filters, resistors, capacitors, inductors, transistors, rectifiers, multiplexors, latches, or any other linear or nonlinear electronic component. For instance, the signal conditioner 220 may include a mixer configured to sum the electrical signals from sound sensors 206 and 208 to output a combined electrical signal of the sum. Alternatively or additionally, in some implementations, signal conditioner 220 includes one or more processors (e.g., processor 102) configured to execute program instructions stored on a data storage (e.g., data storage 104) to manipulate electrical signals received from a particular combination of sound sensors, and to provide an output signal accordingly. In some examples, signal conditioner 220 is configured to perform various measurements and computations, such as delays between receipts of a sound by individual sound sensors, sound power levels, other characteristics of detected sounds, etc.

Platform 230 includes a structure configurable for arranging the plurality of sound sensors of the device 200 (e.g., sensors 202, 204, 206, 208, 210, etc.) in a particular physical arrangement. As shown, for instance, sound sensors 202, 204, 206 are mounted to platform 230 along a substantially circular physical arrangement, and sound sensors 208 and 210 are arranged in predetermined positions relative to sound sensors 202, 204, 206. Other physical arrangements of sound sensors 202, 204, 206, 208, 210 (and/or other sound sensors in device 200) are possible as well. However, for the sake of example, device 200 includes the plurality of sound sensors (e.g., sensors 202, 204, 206, 208, 210, etc.) arranged in the physical arrangement as shown.

In some implementations, platform 230 includes circuitry for electrically coupling one or more components of device 200. For instance, platform 230 may include a substrate, such as a printed circuit board (PCB) for instance, that can be employed both as a mounting platform (e.g., for sensors 202, 204, 206, 208, 210, signal conditioner 220, other chip-based circuitry, etc.) as well as a platform for patterning conductive materials (e.g., gold, platinum, palladium, titanium, copper, aluminum, silver, metal, other conductive materials, etc.) to create interconnects, connection pads, etc. Additionally or alternatively, for instance, through hole pads may be patterned and/or drilled on to platform 230 to facilitate connections between components on more than one side of platform 230. For instance, although not shown, one or more sound sensors (or signal conditioners) could be mounted to a side of platform 230 opposite to the side shown. In some examples, platform 230 includes a multi-layer substrate that allows connections between components (e.g., sensors, signal conditioners, etc.) through several layers of conductive material between opposite sides of platform 230. Thus, in some examples, platform 230 may provide markings (e.g., drilled holes, printed marks, etc.) to facilitate mounting the plurality of sound sensors (e.g., sensors 202, 204, 206, 208, 210) in the particular physical arrangement shown.

It is noted that the shapes, sizes, numbers, positions, and scales of the various components of the device 200 shown in FIG. 2 are for exemplary purposes only. Further, device 200 may include fewer or additional components than those shown. In a first example, the number of sound sensors in the device 200 may be more or less than the number of sound sensors shown. In a second example, the physical arrangement of the sound sensors may be different (e.g., linear, multi-layer, etc.). In a third example, the shape and/or size of the platform 230 may be different (e.g., rectangular, etc.). In a fourth example, signal conditioner 220 may be alternatively included in a separate device coupled to the device 200, or may be located at a different region of the device 200. Other examples are possible as well.

Thus, device 200 could be implemented in various forms other than that shown according to application and/or design requirements of the sound sensor array device 200. In one instance, if the device 200 is used with a computing system having limited computational resources, then the device 200 may include fewer sound sensors than those shown to improve speed of signal processing computations by the system (e.g., sound source localization, separation, etc.). In another instance, the particular physical arrangement of sound sensors in device 200 may be adjusted based on the configuration of the signal conditioner 220 (e.g., mixer properties, etc.), signal processing configurations used with the output of the device 200 (e.g., delay sum beamforming, space-time filtering, filter sum beamforming, frequency domain beamforming, minimum-variance beamforming, etc.), expected frequencies of detected sounds, and/or any other design considerations.

IV. EXAMPLE SOUND SENSOR ARRAY OPERATIONS

Figure 3A:
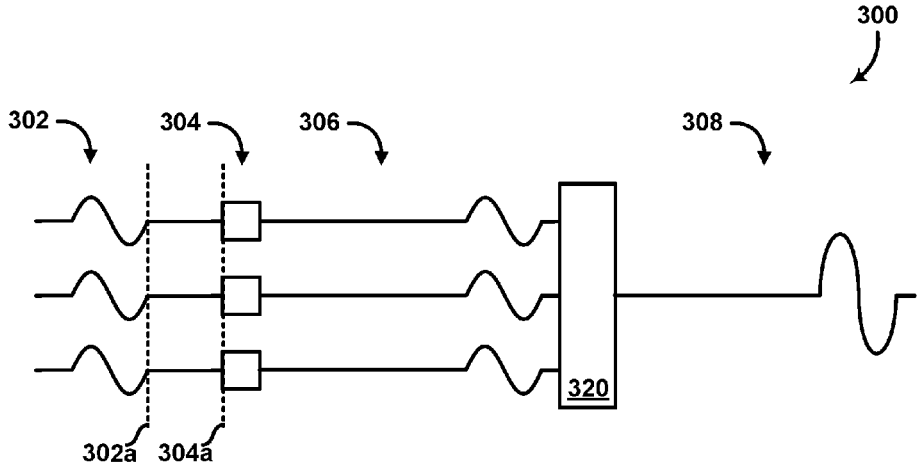
FIG. 3A is a conceptual illustration of an operation of a sound sensor array, according to an example embodiment.

FIG. 3A is a conceptual illustration of an operation of a sound sensor array 300, according to an example embodiment. Sensor array 300 may be similar to the sensor array 200 or a portion thereof. For example, sensor array 300 includes a plurality of sound sensors 304 that may be similar to sound sensors 202, 204, 206, 208, 210 of the sound sensor array 200. As shown, sound sensors 304 are arranged in a linear arrangement 304*a*. However, other arrangements of sound sensors 304 are possible as well such as the arrangement shown in FIG. 2 or any other arrangement. Sensor array 300 includes a signal conditioner 320 coupled to sound sensors 304. In line with the discussion above, signal conditioner 320 may be similar to signal conditioner 220 or may be configured to perform one or more of the functions described for signal conditioner 220, for example. FIG. 3A illustrates a conceptual, two-dimensional illustration of the operating principle behind a sound sensor array.

As shown in FIG. 3A, a set of sound waves 302 are propagating from one or more sound sources (not shown) toward sound sensors 304. For the sake of example, sound waves 302 are shown to be propagating according to a planar wave front 302*a*. However, in other examples, sound waves 302 could be propagating according to a wave front having a different shape (e.g., circular, spherical, etc.). As shown, wave front 302*a* is substantially parallel to line 304*a* of the linear arrangement of sound sensors 304. Thus, in the scenario shown in FIG. 3A, sound waves 302 may be propagating along a direction substantially perpendicular to sound sensor array 300.

When sound waves 302 arrive at respective sound sensors 304, a set of signals 306 are provided by corresponding sound sensors to signal conditioner 320. Signals 306 have a specific phase timing as shown in FIG. 3A. For example, all signals arrive at a substantially similar time (e.g., approximately same phase) due to the direction of sound waves 302 relative to the sound sensors 304. Next, signal conditioner 320 receives signals 306 and generates an output 308 based on a combination of the received signals. For the sake of example, signal conditioner 320 is implemented in the scenario of FIG. 3A as a mixer configured to provide output 308 corresponding to a sum of the signals 306. In this example, as shown, output 308 is a signal having approximately three times the amplitude of each of the signals 308. However, signal conditioner 320 may include additional or different components to process signals 306, such as delays, inverters, etc., in line with the discussion above for the signal conditioner 220. Thus, in some examples (not shown), output 308 has different characteristics (e.g., amplitude, phase, etc.) depending on the configuration of signal conditioner 320.

Figure 3B:
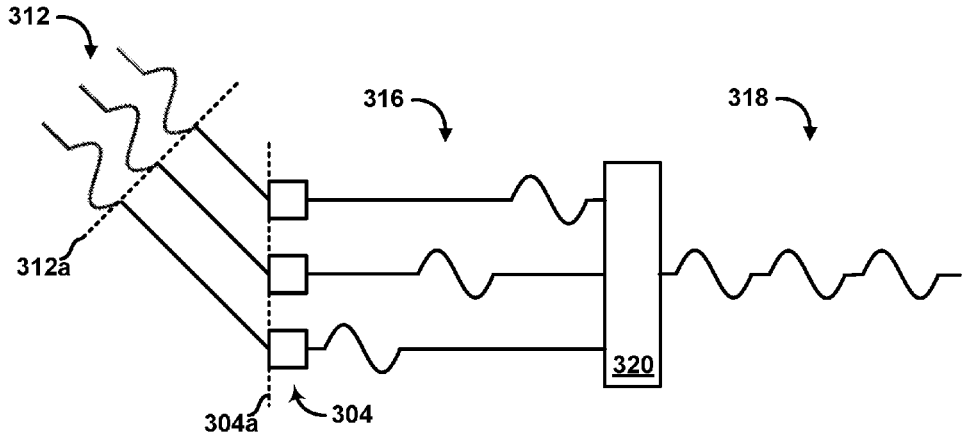
FIG. 3B is a conceptual illustration of another operation of the sound sensor array of FIG. 3A, according to an example embodiment.

FIG. 3B is a conceptual illustration of another operation of the sensor array 300 shown in FIG. 3A. Unlike the scenario of FIG. 3A, sound waves 312 are propagating toward sensors 304 according to wave front 312*a* (e.g., at a different angle-of-arrival relative to sound sensors 604 than the angle-of-arrival associated with sound waves 302). In the scenario shown in FIG. 3B, sound sensors 304 provide output signals 316 when the respective sound waves 312 arrive at the corresponding sound sensors. The top sound wave arrives at the top sound sensor of sound sensors 304 first. Then, after a delay, the sound wave that is second from the top arrives at the sound sensor that is second from the top. After yet another delay, the signal that is third from the top arrives at the sound sensor that is the third from the top.

When a sound wave arrives at its respective sound sensor, a signal is provided by the respective sound sensor to signal conditioner 320 (e.g., signals 316). Because sound waves 312 are propagating at a non-perpendicular angle relative to the linear arrangement 304*a* of sensors 304, the respective signals 316 have different phase timings. Next, signal conditioner 320 sums signals 316 to generate output 318. As shown, output 318 has different characteristics than output 308 due to the difference in phase timings of the respective signals 316.

Within examples, a computing device could analyze sensor array outputs, such as outputs 308 and/or 318, to determine or estimate the direction (and/or location) of the respective sound sources (not shown) emitting sound waves 302 and/or 312. This determination may be based on the predetermined physical arrangement of sound sensors 304 as well as the predetermined signal processing configuration (e.g., sum, delay, filter, etc.) of the signal conditioner 320. In one example implementation, signal conditioner 320 of FIGS. 3A-3B may have a particular delay-sum beamforming configuration such that outputs 308 and/or 310 can be estimated using equation [1] below.

$$\text{output}=\Sigma_{j=0}^{N-1}e^{Aj2\pi fi} \quad [1]$$

In equation [1], N may correspond to the number of sound sensors in the sound sensor array 300, Aj may correspond to a mathematical transformation of the sound waves 302 or 312 with respect to a j-th sensor due to a relative position of the j-th sensor in the array 300, f may correspond to a particular frequency of detected sounds 302 or 312, and i may correspond to an imaginary constant. In the linear arrangement 304*a* of sensors 304 for instance, $A_j$ may correspond to $$\frac{jl\sin(\theta)}{c},$$

where l is the distance between the individual sound sensors 304, θ is the angle-of-arrival of the sounds (e.g., angle between direction of sound and line 304*a*, etc.), and c is the speed of sound (e.g., speed of sound waves 302, 312 in air or other propagation medium in which waves 302, 312 are propagating, etc.). Thus, in some implementations, a computing device is configured to evaluate outputs 308, 310 using the predefined relationship of equation [1] to determine information about sounds 302, 312, such as the respective direction of the sounds (θ) or the respective sound power levels (e.g., gain, etc.) of the sounds. By way of example, the computing device may measure the output 308 of FIG. 3A (e.g., amplitude, phase, frequency, etc.). The computing device can then solve equation [1] using the measured output and predetermined values of N and l (i.e., arrangement of sound sensors 304) to determine the angle-of-arrival θ of sounds 302.

In some implementations, equation [1] includes other parameters additionally or alternatively to the parameters described above. In one implementation, the term A of equation [1] includes parameters related to arrangements of sound sensors 304 other than the linear arrangement 304*a* (e.g., parameters that indicate relative positions of sound sensors in a non-linear arrangement, etc.). In another implementation, equation [1] includes parameters related to locations of sound sources (not shown) emitting sounds 302, 312. A first example parameter relates to a dampening constant to account for attenuation of a sound propagating in a medium (e.g., air, water, etc.) for a given distance between a sound source and a sound sensor. A second example parameter relates to phase offset(s) to account for positions of sound sources relative to a sound sensor. A third example parameter relates to sound sensor characteristics (e.g., frequency response of sound sensors, etc.). In yet another implementation, equation [1] includes parameters related to a signal processing configuration of signal conditioner 320 (e.g., delay sum beamforming parameters, space-time filtering parameters, filter sum beamforming parameters, frequency domain beamforming parameters, minimum-variance beamforming parameters, etc.). Other parameters are possible as well.

In some implementations herein, a computing device is configured to compute simulated sounds for different simulated scenarios by solving a signal conditioner equation such as equation [1]. By way of example, the term $e^{2\pi fi}$ of equation [1] can be computed to simulate a sound wave having a particular frequency (f). Further, the term $A_j$ can be computed for different values of θ, l, and/or c to simulated different arrangements of sound sensors 304, different directions of detected sounds, different propagation mediums, different arrangements of sound sources, or any other parameter. Thus, in some examples, various parameters of equation [1] (or any other signal conditioner equation) are varied to simulate various sounds and corresponding outputs of the array 300, as well as various simulated arrangements of sound sources emitting the simulated sounds, among other simulation parameters.

In some implementations, the computing device is also configured to store simulation results in a database or dataset that includes any number of entries (e.g., hundreds, thousands, etc.). Each entry maps an expected output to a set of simulation parameters. By way of example, consider a scenario where output 308 is an expected output computed based on a set of simulation parameters. In this example, the computing device may store a representation of output 308 (e.g., solution of equation [1], samples of curve 308, etc.) together with an indication of the set of simulation parameters. The set of parameters may include parameters related to the simulated sounds or sound sources (e.g., number of sound sources=1, xyz position of sound source relative to array (meters)=(−10, 0, 0), sound power level of emitted sound=50%*Max_level, frequency of sound=100 Hertz, etc.). The set of parameters may also include parameters related to the sound sensor array configuration (e.g., number of sound sensors=3, relative positions of sound sensors (meters)=(0, 0.1, 0; 0, 0, 0; 0, −0.1, 0), signal processing configuration="delay-sum beamforming", etc.). Other simulation parameters are possible as well in line with the discussion above. Further, in some implementations, the dataset may be configured to allow selecting a subset of the entries having a particular value or range of values for a particular simulated parameter. For example, the computing device may request all entries for simulation results involving only one sound source or two sound sources, each having at least a threshold respective sound power level, among other possibilities.

Note that the conceptual illustrations in FIGS. 3A-3B depict one example of how sound sensor array outputs can be used to deduce information relating to a direction of a sound detected by sound sensors in the sound sensor array. In some examples, the phase timing and gain (e.g., amplitude) of the signal in the output may vary depending on the direction and power of the received sound. While the conceptual illustrations in FIGS. 3A-3B show a two-dimensional example of a sound sensor physical arrangement, in some examples, any two- or three-dimensional arrangement of sound sensors may be utilized to determine the direction of a sound source. As an example, determining phase timing and sound power levels in an output from a sensor array that includes a three-dimensional physical arrangement of sound sensors may provide additional information indicative of a three-dimensional direction of the received sound. It should be understood that, although some examples and figures described herein may refer to or illustrate two-dimensional examples, the techniques of the present application may be applied in three dimensions as well. Additionally, note that the conceptual illustrations in FIGS. 3A-3B are merely illustrative and may not necessarily be drawn to an accurate scale.

V. EXAMPLE SOUND SENSOR ARRAY RESPONSES

Figure 4:
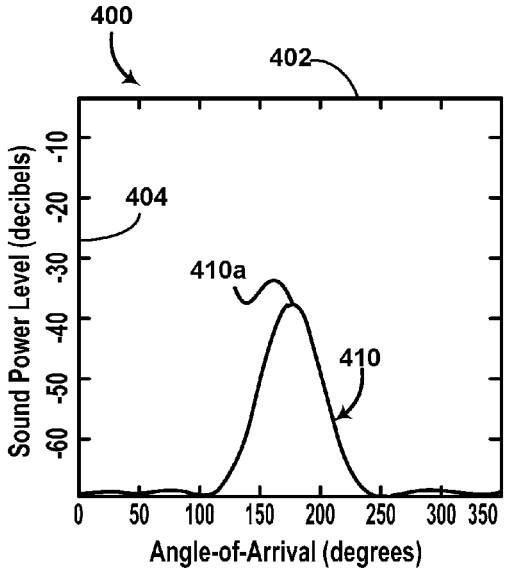
FIG. 4 is a conceptual illustration of a sound sensor array response, according to an example embodiment.

FIGS. 4-7 are conceptual illustrations of sound sensor array responses 400, 500, 600, and 700, in accordance with at least some implementations herein. In FIG. 4, a horizontal axis 402 indicates angles-of-arrival (e.g., direction) of sounds detected by a sound sensor array, and a vertical axis 404 indicates sound power levels of the detected sound in a respective direction. To determine curve 410, for example, equation [1] can be solved at a particular frequency f, for each angle θ on the axis 402 to compute sound power level values associated with axis 404. For instance, a sound power level (e.g., in decibels) may correspond to a ratio of the amplitude of the "output" calculated using equation [1] relative to the amplitude of the sounds detected by one of the sensors 304 of the array 300. Other techniques for measuring a sound power level are possible as well.

Figure 5:
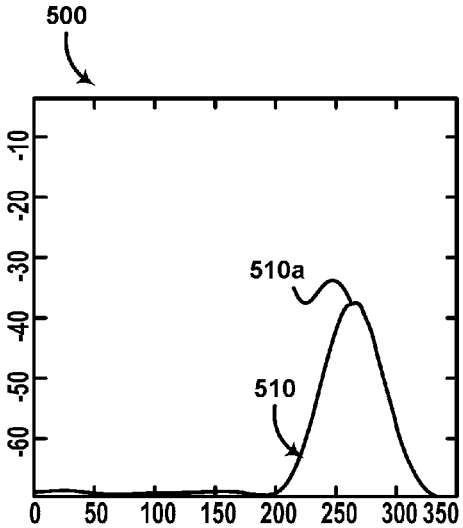
FIG. 5 is a conceptual illustration of another sound sensor array response, according to an example embodiment.
Figure 6:
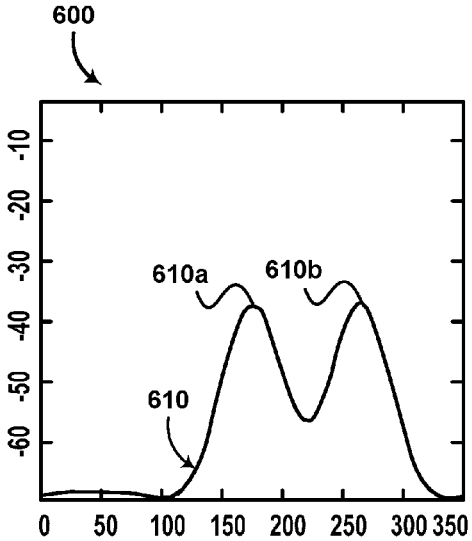
FIG. 6 is a conceptual illustration of yet another sound sensor array response, according to an example embodiment.
Figure 7:
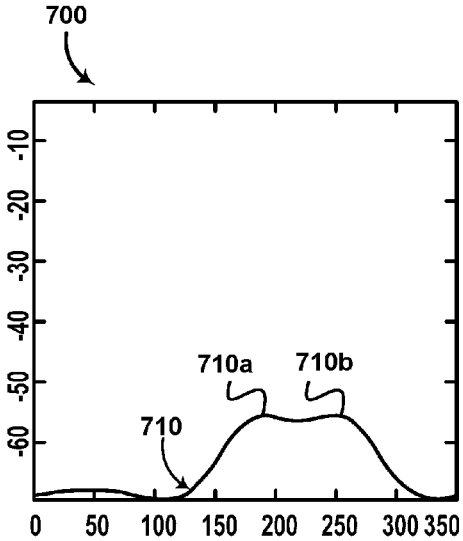
FIG. 7 is a conceptual illustration of still another sound sensor array response, according to an example embodiment.

Similarly, in FIGS. 5-7, sound sensor array responses 500, 600, 700 illustrate relationships between detected sound power levels and angles-of-arrival in other conditions involving different sounds. Thus, similarly to curve 410, the values indicated by curves 510, 610, 710 are computed based on a combination of outputs from a plurality of sensors in a sound sensor array, for example.

Note that while the conceptual illustrations of FIGS. 4-7 show respective relationships between sound power levels and angles-of-arrival, responses 400, 500, 600, 700 could additionally or alternatively map relationships involving other sound detection characteristics. Example sound detection characteristics include azimuth direction, elevation direction, location of sound source, number of sound sources, frequencies of detected sounds, time delay between receipts of a sound by different sound sensors, among others. In practice, for example, data indicating these characteristics is stored in a dataset along with an indication of relationships (e.g., mapping) between the different characteristics. Further, note that the conceptual illustrations in FIGS. 4-7 are merely illustrative and may not necessarily be drawn to an accurate scale.

In some implementations, a computing device, such as device 100 for example, is configured to deduce information about detected sounds based on an analysis of the sound sensor array responses 400, 500, 600, and/or 700.

In a first example, the computing device may determine that response 400 has a local maximum 410*a* that corresponds to a first angle-of-arrival on axis 402 (e.g., 180°). In this example, the computing device may thus estimate that detected sounds associated with the response 400 originated from a sound source at a 180° direction from the sound sensor array. Whereas, in this example, the computing device may determine that response 500 has a local maximum 810*a* that corresponds to a second angle-of-arrival (e.g., 270°), and may thus estimate that detected sounds associated with the response 500 originated from a sound source at a 270° direction from the sound sensor array.

In a second example, the computing device may estimate the number of sound sources associated with a response based on the number of local maxima above a threshold (e.g., 70% of the maximum sound power level, etc.). In this example, the computing device may determine that response 400 has one local maximum 410*a* above the threshold, and thus the computing device may estimate that detected sounds associated with response 400 originate from one sound source. Whereas, in this example, the computing device may determine that response 600 has two local maxima 610*a* and 610*b*, and thus detected sounds associated with response 600 originate from two respective sound sources.

As a variation of the example above, consider a scenario where two sound sources are separated by a relatively small distance (e.g., ten centimeters, etc.) while emitting sounds at the same frequency or within the same frequency band. In this scenario, one of the two sound sources is emitting a sound that is relatively louder (e.g., higher sound power level) than another sound emitted by the other sound source. In this example, a response associated with the combination of the sounds may appear similar to response 700 without one of the local maximum 710*b*, but with rather a small variation in the curvature of curve 710 at the angle-of-arrival associated with local maximum 710*b*. In some implementations, a computing device estimates the number of sound sources in this scenario as two sound sources even if the generated response only has one local power maximum. To do so, for example, the computing device matches the generated response with a corresponding simulated response (e.g., simulated response may also have the small variation in the curvature). Other examples are possible as well.

VI. EXAMPLE METHODS AND COMPUTER READABLE MEDIA

Figure 8:
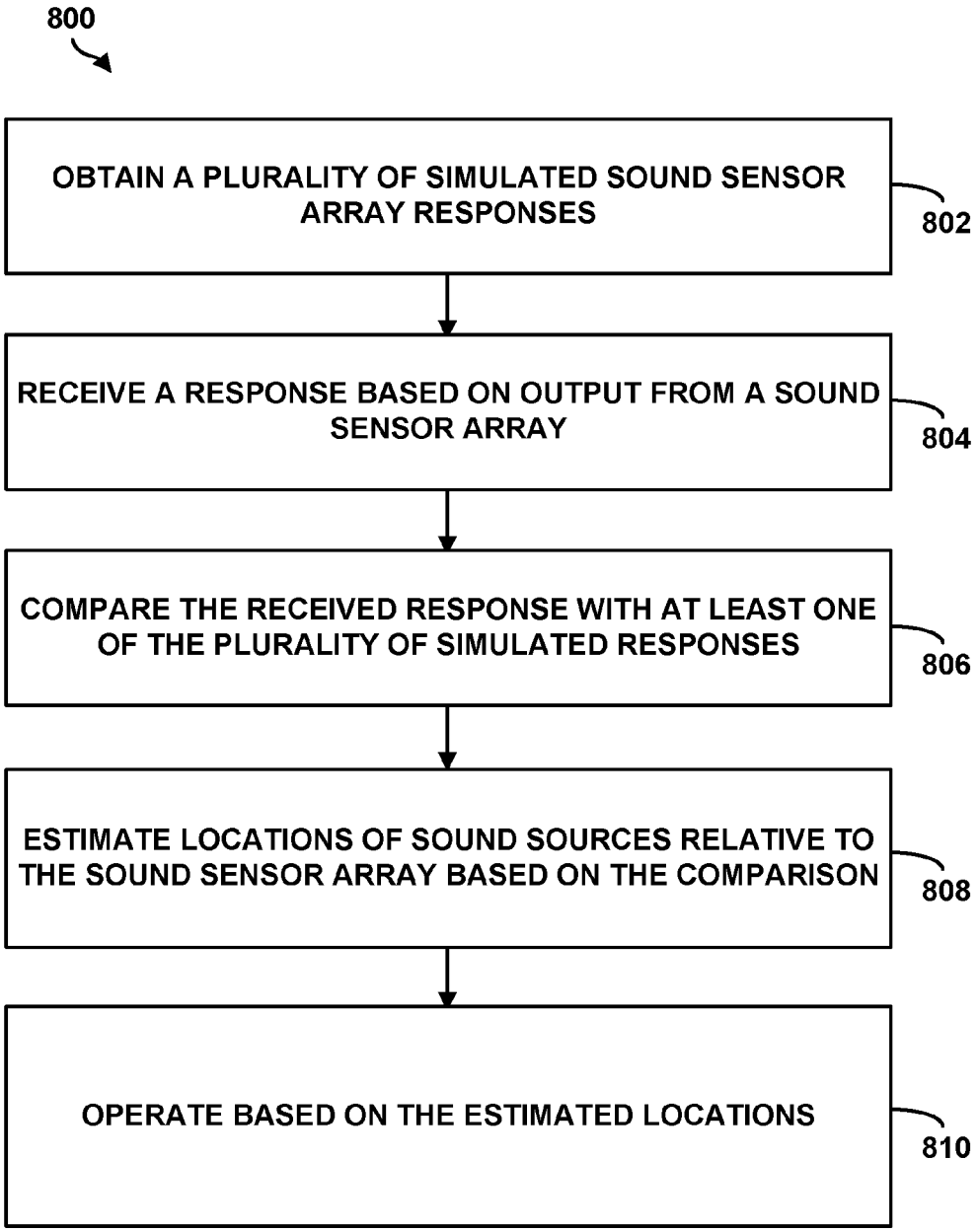
FIG. 8 illustrates a flowchart, according to an example embodiment.

FIG. 8 illustrates a flowchart of an example method 800, according to an example implementation. Method 800 shown in FIG. 8 presents an implementation that could be used with devices 100 and/or 200, for example, or more generally by one or more components of any computing device. Method 800 may include one or more operations, functions, or actions as illustrated by one or more blocks of 802-810. Although the blocks are illustrated in a sequential order, these blocks may also be performed in parallel, and/or in a different order than those described herein. Also, the various blocks may be combined into fewer blocks, divided into additional blocks, and/or removed based upon the directed implementation.

In addition, for the method 800 and other processes and methods disclosed herein, the block diagram shows functionality and operation of one possible implementation. In this regard, each block may represent a module, a segment, or a portion of program code, which includes one or more instructions executable by a processor or computing device for implementing specific logical operations or steps in the process. The program code may be stored on any type of computer-readable medium, for example, such as a storage device included in a disk or hard drive. The computer-readable medium may include a non-transitory computer-readable medium, for example, such as computer-readable media that stores data for short periods of time like register memory, processor cache and/or random access memory (RAM). The computer-readable medium may also include non-transitory media, such as secondary or persistent long-term storage, like read-only memory (ROM), optical or magnetic disks, and compact-disc read-only memory (CD-ROM), for example. The computer-readable media may be considered a computer-readable storage medium, for example, or a tangible storage device. Additionally or alternatively, each block in FIG. 8 may represent circuitry that is wired to perform the specific logical operations in the process.

In some scenarios, the computations and estimations described in FIGS. 4-7 may be less accurate than in other scenarios. By way of example, consider a scenario where sounds from a first sound source associated with response 400 and a second sound source associated with response 500 are detected simultaneously by the sound sensor array. In some cases, a computing device may receive (or determine) a response similar to response 600 of FIG. 6. For instance, response 600 may correspond to a spectral sum of responses 400 and 500, and thus local maxima 610*a* and 610*b* may correspond, respectively, to local maxima 410*a* and 510*a*. However, in other cases, the response received by the computing device may be more similar to response 700 of FIG. 7 due to interaction between the sounds. Thus, in this scenario, the discrepancy between responses 600 and 700 may lead to inaccuracies in the various estimations and computations described in FIGS. 4-7. For example, the computing device may estimate the directions (e.g., angles-of-arrival) of the two sound sources based on local maxima 710*a* and 710*b* to be 200° and 250° (instead of, respectively, the 180° and 270° directions of responses 400 and 500). FIG. 8 illustrates example implementations for estimating directions of sound sources, estimating locations of sound sources, and/or separating sounds from multiple sound sources, while mitigating the effect of such interaction.

In some implementations, method 800 is operable by a device coupled to a sound sensor array that includes a plurality of sound sensors in a particular physical arrangement. In other implementations, method 800 is operable by a device in communication with a remote device that includes a sound sensor array.

At block 802, the method 800 involves obtaining a plurality of simulated responses mapping respective simulated physical arrangements of one or more simulated sound sources to respective expected outputs from a sound sensor array. In some implementations, the sound sensor array includes a plurality of sound sensors in a particular physical arrangement, similarly to sound sensor arrays 200 and 300 for example. In one example, the simulated responses include data indicative of a relationship between a simulated angle-of-arrival (e.g., direction) of a simulated sound and a sound power level of the sound, similarly to responses 400, 500, 600, and/or 700. Additionally or alternatively, in some examples, a simulated response includes an indication of a simulated physical arrangement of sound sources from which the simulated sounds originate. Other examples are possible as well in line with the discussion above.

In some implementations, a computing device of the method 800 generates the plurality of simulated responses by computing simulated sounds having simulated characteristics similar to characteristics of sounds 302 or 312 or any other sound, for instance. The simulated sounds may be simulated as originating from one or more simulated sound sources associated with any combination of simulation parameters. Example simulation parameters include: number of sound sources, location of each sound source, sound power level of each sound source, among others. The computing device then computes, for various combinations of simulation parameters, simulated outputs of the sound sensor array (e.g., signals 306, 316 and/or outputs 308, 318) based on the simulated physical arrangements of the sound sources, the particular physical arrangement of the sound sensors in the array, and the particular signal processing configuration of a signal conditioner (e.g., conditioner 320, etc.) associated with the sound sensor array. In some examples, the simulated responses are computed in response to an event, such as detection of a sound or receipt of an input among others. In other examples, the simulated responses are computed by the computing device without an occurrence of such event (e.g., periodically, automatically, etc.).

In one implementation, the computing device determines a plurality of locations at varying distances to the sound sensor array. For instance, the plurality of locations may correspond to a grid or matrix of uniformly separated points in the environment of the array. The computing device then performs a plurality of simulations to simulate one or more sound sources assigned to one or more of the plurality of locations. A first simulation may involve a particular number of simulated sound source(s). Each simulated sound source may be assigned to a particular location of the plurality, a simulated sound frequency, a simulated power level, or any other parameter associated with a sound source. A second simulation may involve a different number of simulated sound source(s). A third simulation may involve different location(s) for one or more of the simulated sound source(s). A fourth simulation may involve one or more of the simulated sound source(s) having different simulated frequencies, or different sound power levels. Other example simulations associated with different combinations of simulation parameters are possible as well. For each example simulation, the computing device may compute simulated sound(s) emitted by each simulated sound source (e.g., the term $e^{2\pi fi}$ of equation [1], etc.) according to the assigned simulation parameters.

In this implementation, the various simulation parameters may be selected based on an application of the computing device. In one example, the computing device may be expected to operate in an environment that includes only one sound source having at least a threshold high sound power level. In this example, the computing device selects more simulation parameters that involve only one sound source having the at least threshold high sound power level. Further, in this example, the computing device selects fewer simulation parameters that involve more than one sound source having the at least threshold high sound power level. In another example, the computing device may be expected to determine locations of sound sources with a relatively high accuracy. However, in this example, a relatively low accuracy of estimating the power levels of detected sounds may be suitable for the application of this example. Thus, in this example, the computing device selects simulation parameters that involve a relatively high granularity of sound source positions. For instance, the computing device may perform multiple simulations by adjusting a sound source position by a small amount after each simulation. Further, in this example, the computing device selects simulation parameters that involve a relatively lower granularity of sound power levels (e.g., fewer simulations involving different sound power levels for a simulated sound source in a particular simulated position, etc.).

Continuing with this implementation, the computing device then applies a transform (e.g., the term $A_j$ of equation [1], etc.) to account for various factors affecting the propagation of a simulated sound from a simulated sound source to each sound sensor of the array. Example factors encompassed by the transform include attenuation (dampening) of the simulated sound, a phase shift caused by distance between a simulated sound source and a respective sound sensor, an angle-of-arrival of each simulated sound, among others.

In this implementation, the computing device then computes, for each sound sensor in the array, a simulated electrical signal (e.g., signals 306, 316) provided by the sound sensor based on a sum of the simulated sounds at the particular location of the sound sensor. Referring back to FIGS. 3A and 3B by way of example, consider a scenario where both sound waves 302 and 312 are detected by sensors 304 (i.e., two sound sources). In this scenario, the term $e^{Aj2\pi ft}$ of equation [1] can be computed for sound wave 302 and added to a similar term computed for sound wave 312 to generate a combined term instead of the original $e^{Aj2\pi ft}$ term. The computing device then computes expected outputs (e.g., outputs 308, 318) from the sensor array based on the simulated signals and a predefined relationship (e.g., equation [1]) between array outputs and sound sensor signals. Continuing with the example scenario above, the computing device may solve equation [1] using the combined term instead of the $e^{Aj2\pi ft}$ term.

Additionally, in this implementation, the computing device also stores a mapping between the computed expected outputs and the various selected simulation parameters (e.g., simulated physical arrangements of simulated sound sources, etc.). Additionally, in some instances, the computing device may also determine additional parameters, such as the signal processing configuration used to compute the expected outputs, and sound sensor characteristics (e.g., sound sensor sensitivity, etc.), among others. In these instances, the computing device may include the additional parameters with other simulation parameters in the mapping as well.

In some implementations, the computing device accesses a dataset storing precomputed or predetermined simulated responses to retrieve the plurality of simulated responses. In one example, the dataset is stored in a memory or data storage of the computing device (e.g., data storage 104). In another example, the dataset is stored in a remote device accessible to the computing device via a communication interface (e.g., interface 114). Other examples are possible as well.

In some implementations, method 800 also involves receiving an indication of the particular physical arrangement of the plurality of sound sensors from a remote device via a communication interface, and obtaining the plurality of simulated responses based on the indication. In an example implementation, a robotic device includes the sound sensor array, and communicates an indication of the configuration of the sensor array (e.g., the particular arrangement of sound sensors) to a server device. The server device then computes the simulated responses based on the configuration of the sensor array or identifies/retrieves the simulated responses from a dataset of precomputed responses based on the indicated configuration. The server device then transmits an indication of the plurality of simulated responses to the robotic device. Accordingly, in some implementations, obtaining the plurality of simulated responses at block 802 comprises obtaining the plurality of simulated responses from a dataset that includes predetermined simulated responses related to the particular physical arrangement of sound sensors in the array. In other implementations, obtaining the plurality of simulated responses at block 802 comprises computing the plurality of simulated responses based on the particular physical arrangement of the sound sensors in the array.

At block 804, the method 800 involves receiving a response based on output from the sound sensor array. In some examples, the response is indicative of the sound sensor array detecting sounds from a plurality of physical sound sources in an environment of the sound sensor array. In some implementations, the output includes a conditioned signal based on a combination of signals from multiple sound sensors in the array, similarly to outputs 308 or 318 of the sensor array 300 for instance. In other implementations, the output includes signals provided by one or more sound sensors in the array, similarly to signals 306 or 316 for instance. Regardless of the configuration of the output, the received response may indicate one or more relationships between any combination of characteristics of the detected sounds, similarly to responses 400, 500, 600, or 700 for instance.

At block 806, the method 800 involves comparing the received response with at least one of the plurality of simulated responses. In some implementations, the comparison at block 806 involves a computing device comparing one or more characteristics of the received response with corresponding characteristics of a simulated response. For instance, the computing device may determine data, such as data indicated by curves 410, 510, 610, 710, for the received response and for the simulated response. A first example characteristic includes an indication of the area (or volume) encompassed by a curve (e.g., curve 410, 510, 610, 710, etc.) associated with a respective response. A second example characteristic includes the number of local maxima (e.g., local maxima 610*a*, 610*b*, etc.) associated with a respective response. A third example characteristic includes sound power levels associated with local maxima, local minima, or any other spectral feature of a respective response. A fourth example characteristic includes values (e.g., angle-of-arrival, azimuth direction, elevation direction, etc.) of local maxima, local minima, etc., associated with a respective response. Other characteristics are possible as well including any data characteristics evaluated by various statistical or heuristic data comparison algorithms or processes (e.g., machine-learning comparison algorithms, etc.).

In some implementations, a computing device of the method 800 matches a particular simulated response with the received response based on the comparison at block 806 indicating less than a threshold difference between one or more characteristics of the received response and corresponding one or more characteristics of the particular simulated response (e.g., difference between areas under curves, difference between number of local maxima, etc.). Additionally, in some examples, the threshold difference is based on a configuration or application of the computing device. For instance, a computing device configured for automatic speech recognition (ASR) could use a low threshold difference for highly accurate sound estimations or computations suitable for ASR applications. Whereas, for instance, a computing device of a multimedia system that selects one of a limited list of channels based on the detected sounds could apply a high threshold difference suitable for achieving less accurate estimations or computations that are still suitable for the multimedia system applications.

As noted above, in some implementations, the plurality of simulated responses are obtained at block 802 from a dataset storing the simulated responses. However, in some scenarios, the dataset may include a large amount of data for a large number of simulated responses that are less relevant to the received response at block 804 than other simulated responses in the dataset. For instance, the dataset may include simulated responses associated with sound sensor arrays having a different arrangement of sound sensors than the particular arrangement of sound sensors in the sound sensor array providing the output associated with the response received at block 804.

Accordingly, in some implementations, the comparison at block 806 also involves identifying a subset of the plurality of simulated responses having one or more characteristics associated with corresponding one or more characteristics of the response received at block 804. Through this process, for example, a computing device of the method 800 could reduce the number of comparisons between the received response and simulated responses at block 806.

A first example characteristic includes respective simulated physical arrangements associated with the respective simulated responses. A second example characteristic relates to the frequency or frequency band associated with the respective simulated responses. A third example characteristic includes an indication of the signal processing configuration associated with a respective response. In a first implementation, a respective response includes an indication of the signal processing configuration (e.g., delay sum beamforming, space-time filtering, filter sum beamforming, frequency domain beamforming, minimum-variance beamforming, etc.). In a second implementation, the signal processing configuration is indicated in configuration data associated with respective response (e.g., stored in the dataset with each simulated response, stored in configuration data related to the sound sensor array, etc.). In a third implementation, the method 800 also involves interrogating the sound sensor array for an indication of the signal processing configuration. Other implementations are possible as well. Accordingly, in some implementations, the method 800 also involves identifying the subset of the plurality of simulated responses based on at least a determination that respective simulated responses of the subset are associated with the signal processing configuration of the received response.

As noted above, other example characteristics are possible as well including the number, sound power level, angle-of-arrival, azimuth direction, elevation direction, etc., of the local maxima/minima associated with a respective response. Accordingly, in some implementations, the method 800 also involves determining characteristics of one or more local sound power level maxima in the received response. In these implementations, the method 800 also involves identifying the subset of the plurality of responses based at least on respective simulated responses therein having corresponding characteristics of one or more simulated local sound power level maxima within a threshold of the determined characteristics. In line with the discussion above, the threshold may have any value based on a configuration or application (e.g., target accuracy, tolerance, error rate, etc.) of the computing device of the method 800.

Thus, in some implementations, determining the characteristics of the one or more local maxima of the received response comprises determining a number of the local maxima of the received response, and identifying the subset of the plurality of responses based on at least a determination that the respective simulated responses of the subset and the received response at block 804 are associated with a same number of local maxima. Further, in some implementations, determining the characteristics involves determining expected directions of at least one sound associated with the one or more local maxima of the received response. Referring back to FIG. 4 by way of example, a computing device of the method 800 may determine the horizontal axis 402 value that corresponds to the local maximum 410*a*. Further, in some embodiments, determining the characteristics involves determining sound power levels of the local maxima of the received response over a particular frequency spectrum. Continuing with the example of FIG. 4, the computing device may determine the vertical axis 404 value that corresponds to the local maximum 410*a*, where the curve 410 indicates sound power levels of the response 400 at the particular frequency spectrum (e.g., approximately 10,000 Hertz, etc.).

In some implementations, the dataset storing the plurality of simulated responses is configured to include one or more indexes mapping respective simulated responses to respective characteristics of the simulated responses as well as to respective simulation parameters. For instance, the one or more indexes may be precomputed as pointers or any other data identifiers for retrieving particular simulated responses in the dataset having a particular characteristic (e.g., two local maxima, three local maxima, etc.) and/or a particular simulation parameter (e.g., delay sum beamforming configuration, frequency band, sound source arrangement/configuration, etc.). Thus, in some implementations, the comparison at block 806 involves identifying the subset of the plurality of simulated responses based on the one or more indexes. By way of example, where the received response is associated with two local maxima, a computing device of the method 800 may select an index pointing to the subset of simulated responses in the dataset having two local maxima. Through this process, for example, computational efficiency improvements can be achieved during extraction of data from the dataset as well reducing the number of comparisons at block 806.

At block 808, the method 800 involves estimating locations of the plurality of sound sources relative to the sound sensor array based on the comparison at block 806. In one implementation, the estimated locations may correspond to simulated locations of simulated sound sources associated with a particular simulated response selected from the plurality of simulated responses. For instance, the particular simulated response may have one or more characteristics within a threshold difference to corresponding characteristics of the received response, and thus the computing device in this instance may estimate the simulated locations of the simulated sound sources as the locations of the physical sound sources associated with the received response. Thus, in some implementations, the method 800 also involves providing simulated locations of simulated sound sources associated with the at least one of the plurality of simulated responses as the estimated locations of the plurality of sound sources in the environment of the sound sensor array. In other implementations, the estimated locations could be determined based on multiple selected simulated responses. For instance, the computing device may identify multiple simulated responses having characteristics within the threshold difference to corresponding characteristics of the received response. In this instance, the computing device in this instance could then compute an average (e.g., midpoint, etc.) location between respective simulated locations associated with the identified simulated responses. The computing device could then provide the computed average location as the estimated location of a respective physical sound source in the environment of the sound sensor array. Other examples are possible as well in line with the discussion above.

In some implementations, the method 800 also involves determining a simulated sound expected from a sound source associated with the at least one of the plurality of simulated responses. In these implementations the method 800 also involves estimating a particular sound from a particular sound source in the environment of the sound sensor array based on the simulated sound. For example, a particular simulated response matched to the received response may indicate simulation parameters for each simulated sound source associated with the particular simulated response. Thus, in this example, a computing device of the method 800 could generate or provide an indication of a simulated sound from each simulated sound source as the sound from corresponding physical sound sources in the environment of the sound sensor array. Thus, in some implementations, estimating the particular sound comprises providing the simulated sound as the particular sound. Through this process, for example, the present disclosure provides implementations for an improved sound source separation technique that mitigates effects of sound interaction in scenarios where multiple sounds from multiple sound sources are detected simultaneously by the sound sensor array.

At block 810, the method 800 involves operating based on the estimated locations of the plurality of sound sources relative to the sound sensor array. By way of example, consider a scenario where a robot includes the sound sensor array of the method 800. The robot in this scenario may determine that a speech request was received from a user requesting that the robot move toward a user. Thus, in this scenario, the robot could use an estimated location of the user (i.e., sound source) determined at block 808 as a basis for actuating robotic components (e.g., robotic legs, wheels, etc.) to cause the robot to move toward the user. Thus, in some implementations, operating the computing device at block 810 involves providing operation instructions to one or more components in the computing device.

As another example, consider a scenario where a server device is configured to perform the method 800. In the example scenario, the sound sensor array is included in a remote device accessible to the server via a network. The remote device in this scenario may be recording a video of a live performance. In this scenario, the server receives the response at block 802 from the remote device via the network. The server then determines an estimated location of a particular performer (e.g., sound source) in the live performance and generates instructions for controlling a focus configuration of a camera in the remote device. The server in this scenario then provides the generated instructions via the network to the remote device. Other example scenarios are possible as well. Accordingly, in some implementations, operating the computing device at block 810 involves providing operation instructions for a remote device via a communication interface (e.g., communication interface 114, etc.) based on the estimated locations of the plurality of sound sources determined at block 808.

Figure 9:
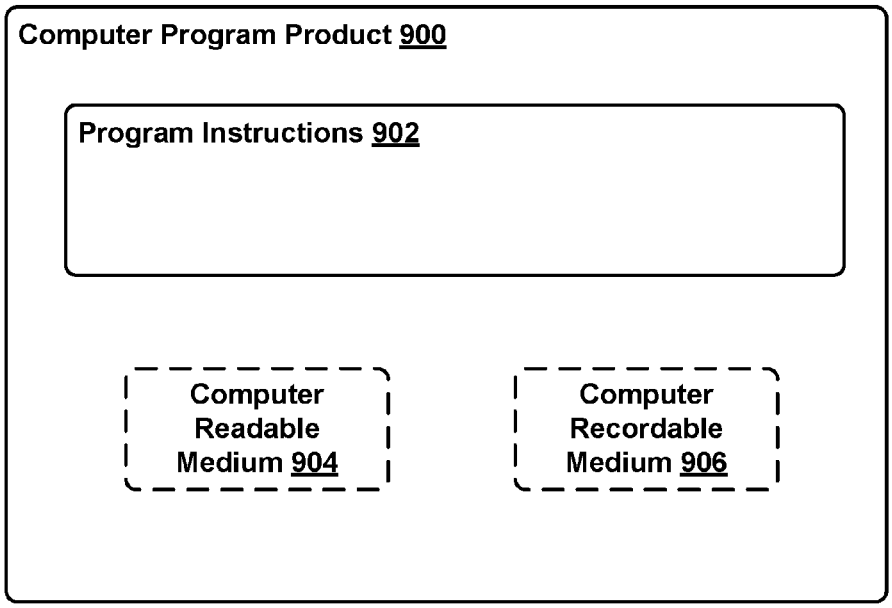
FIG. 9 illustrates a computer-readable medium, according to an example embodiment.

FIG. 9 illustrates an example computer-readable medium configured according to at least some implementations described herein. In example implementations, a system can include one or more processors, one or more forms of memory, one or more input devices/interfaces, one or more output devices/interfaces, and machine readable instructions that when executed by the one or more processors cause a device to carry out the various operations, tasks, capabilities, etc., described above.

As noted above, the disclosed procedures can be implemented by computer program instructions encoded on a computer-readable storage medium in a machine-readable format, or on other media or articles of manufacture. FIG. 9 is a schematic illustrating a conceptual partial view of a computer program product that includes a computer program for executing a computer process on a computing device, arranged according to at least some implementations disclosed herein.

In some implementations, the example computer program product 900 may include one or more program instructions 902 that, when executed by one or more processors may provide functionality or portions of the functionality described above with respect to FIGS. 1-8. In some examples, the computer program product 900 may include a computer-readable medium 904, such as, but not limited to, a hard disk drive, a Compact Disc (CD), a Digital Video Disk (DVD), a digital tape, memory, etc. In some implementations, the computer program product 900 may include a computer recordable medium 906, such as, but not limited to, memory, read/write (R/W) CDs, R/W DVDs, etc.

The one or more program instructions 902 can be, for example, computer executable and/or logic implemented instructions. In some examples, a computing device is configured to provide various operations, or actions in response to the program instructions 902 conveyed to the computing device by the computer readable medium 904 and/or the computer recordable medium 906. In other examples, the computing device can be an external device in communication with a device coupled to the robotic device.

The computer readable medium 904 can also be distributed among multiple data storage elements, which could be remotely located from each other. The computing device that executes some or all of the stored instructions could be an external computer, or a mobile computing platform, such as a smartphone, tablet device, personal computer, or a wearable device, among others. Alternatively, the computing device that executes some or all of the stored instructions could be a remotely located computer system, such as a server. For example, the computer program product 900 can implement operations discussed in reference to FIGS. 1-8.

VII. CONCLUSION

It should be understood that arrangements described herein are for purposes of example only. As such, those skilled in the art will appreciate that other arrangements and other elements (e.g. machines, interfaces, operations, orders, and groupings of operations, etc.) can be used instead, and some elements may be omitted altogether according to the desired results. Further, many of the elements that are described are functional entities that may be implemented as discrete or distributed components or in conjunction with other components, in any suitable combination and location, or other structural elements described as independent structures may be combined.

While various aspects and implementations have been disclosed herein, other aspects and implementations will be apparent to those skilled in the art. The various aspects and implementations disclosed herein are for purposes of illustration and are not intended to be limiting, with the true scope being indicated by the following claims, along with the full scope of equivalents to which such claims are entitled. It is also to be understood that the terminology used herein is for the purpose of describing particular implementations only, and is not intended to be limiting.

What is claimed is:

1. A method operable by a device coupled to a sound sensor array, the sound sensor array including a plurality of sound sensors in a particular physical arrangement, the method comprising:

obtaining a plurality of simulated responses mapping respective simulated physical arrangements of one or more simulated sound sources to respective expected outputs from the sound sensor array;

receiving, based on output from the sound sensor array, a response indicative of the sound sensor array detecting sounds from a plurality of sound sources in an environment of the sound sensor array;

comparing the received response with at least one of the plurality of simulated responses;

based on the comparison, estimating locations of the plurality of sound sources relative to the sound sensor array; and operating the device based on the estimated locations of the plurality of sound sources relative to the sound sensor array.

2. The method of claim 1, wherein comparing the received response with the at least one of the plurality of simulated responses comprises:

identifying a subset of the plurality of simulated responses having one or more characteristics associated with corresponding one or more characteristics of the received response, wherein the corresponding one or more characteristics relate to sound power levels of the detected sounds.

3. The method of claim 2, wherein identifying the subset of the plurality of simulated responses comprises:

accessing a dataset including the plurality of simulated responses, wherein the dataset includes one or more indexes mapping respective simulated responses to respective characteristics, and wherein identifying the subset is based on the one or more indexes.

4. The method of claim 2, wherein identifying the subset of the plurality of simulated responses comprises:

determining a signal processing configuration associated with the received response, wherein identifying the subset is based on at least a determination that respective simulated responses of the subset are associated with the signal processing configuration.

5. The method of claim 2, further comprising:

determining characteristics of one or more local sound power level maxima in the received response, wherein identifying the subset of the plurality of simulated responses is based at least on respective simulated responses therein having corresponding characteristics of one or more simulated local sound power level maxima within a threshold to the determined characteristics.

6. The method of claim 5, further comprising:

determining a number of the local maxima of the received response, wherein the determined characteristics include the number of the local maxima.

7. The method of claim 6, wherein identifying the subset of the plurality of simulated responses is based on at least a comparison between a number of simulated local maxima in the respective simulated responses of the subset and a corresponding number of local maxima in the received response.

8. The method of claim 5, further comprising:

determining, based on the received response, expected directions of at least one sound associated with the one or more local maxima of the received response, wherein the determined characteristics include the expected directions.

9. The method of claim 5, further comprising:

determining sound power levels of the local maxima of the received response, wherein the determined characteristics include the determined sound power levels over a particular frequency spectrum.

10. The method of claim 1, wherein estimating the locations of the plurality of sound sources comprises:

providing simulated locations of simulated sound sources associated with the at least one of the plurality of simulated responses as the estimated locations of the plurality of sound sources in the environment of the sound sensor array.

11. The method of claim 1, further comprising:

determining a simulated sound expected from a sound source associated with the at least one of the plurality of simulated responses; and estimating, based on the simulated sound, a particular sound from a particular sound source of the plurality of sound sources in the environment of the sound sensor array.

12. The method of claim 11, wherein estimating the particular sound comprises providing the simulated sound as the particular sound.

13. An article of manufacture including a non-transitory computer-readable medium, having stored thereon program instructions that, upon execution by a computing device, cause the computing device to perform operations comprising:

obtaining, for a sound sensor array comprising a plurality of sound sensors in a particular physical arrangement, a plurality of simulated responses mapping respective simulated physical arrangements of one or more simulated sound sources to respective expected outputs from the sound sensor array;

determining, based on output from the sound sensor array, a response indicative of the sound sensor array detecting sounds from a plurality of sound sources in an environment of the sound sensor array;

comparing the determined response with at least one of the plurality of simulated responses;

based on the comparison, estimating locations of the plurality of sound sources relative to the sound sensor array; and operating based on the estimated locations of the plurality of sound sources relative to the sound sensor array.

14. The article of manufacture of claim 13, wherein the operations further comprise:

determining a simulated sound expected from a sound source associated with the at least one of the plurality of simulated responses; and estimating, based on the simulated sound, a particular sound from a particular sound source of the plurality of sound sources in the environment of the sound sensor array.

15. The article of manufacture of claim 13, wherein the operations further comprise:

accessing a dataset including the plurality of simulated responses, wherein the dataset includes one or more indexes mapping respective simulated responses to respective simulation parameters associated with the plurality of simulated responses; and identifying, from the dataset, the plurality of simulated responses based on the one or more indexes.

16. A device comprising: a communication interface; at least one processor; and data storage storing program instructions that, when executed by the processor, cause the device to perform operations comprising: obtaining, for a sound sensor array that includes a plurality of sound sensors in a particular physical arrangement, a plurality of simulated responses mapping respective simulated physical arrangements of one or more simulated sound sources to respective expected outputs from the sound sensor array; receiving, from a remote device via the communication interface, a response based on output from the sound sensor array, wherein the response is indicative of the sound sensor array detecting sounds from a plurality of sound sources in an environment of the sound sensor array, and wherein the sound sensor array is included in the remote device; comparing the received response with at least one of the plurality of simulated responses; based on the comparison, estimating locations of the plurality of sound sources relative to the sound sensor array; and providing, via the communication interface, operation instructions for the remote device based on the estimated locations of the plurality of sound sources.

17. The device of claim 16, wherein the operations further comprise: receiving, from the remote device via the communication interface, an indication of the particular physical arrangement of the plurality of sound sensors in the sound sensor array, wherein obtaining the plurality of simulated responses is based on the received indication.

18. The device of claim 17, wherein obtaining the plurality of simulated responses comprises obtaining, based on the particular physical arrangement, the plurality of simulated responses from a dataset that includes predetermined simulated responses.

19. The device of claim 18, wherein the dataset includes one or more indexes mapping the predetermined simulated responses in the dataset to respective physical arrangements of sound sensors, and wherein obtaining the plurality of simulated responses comprises identifying an index mapping the plurality of simulated responses to the particular physical arrangement in the received indication.

20. The device of claim 17, wherein obtaining the plurality of simulated responses comprises computing the plurality of simulated responses based on the particular physical arrangement.

* * * * *